United States Patent [19]

Volkert

[11] Patent Number: 4,867,480

[45] Date of Patent: Sep. 19, 1989

[54] METHOD OF MAKING POP-UPS WITH PLACARD DISPLAY

[75] Inventor: John K. Volkert, Northfield, Ill.

[73] Assignee: One Up, Inc., Northfield, Ill.

[21] Appl. No.: 197,049

[22] Filed: May 20, 1988

[51] Int. Cl.[4] ..... B42B 15/00; G09F 3/00; G09F 1/00; A45B 27/00

[52] U.S. Cl. ..... 283/117; 428/43; 428/12; 40/124.1

[58] Field of Search ..... 283/1 R; 40/124.1, 160, 40/530; 446/71, 148; 428/12, 43

[56] References Cited

U.S. PATENT DOCUMENTS

| | | | |
|---|---|---|---|
| 1,964,278 | 6/1934 | Walter | 446/148 |
| 1,992,618 | 2/1935 | Jeffreys | 446/148 |
| 2,114,824 | 4/1938 | Watsky | 446/148 |
| 2,544,783 | 3/1951 | Freedman et al. | 446/148 |
| 3,235,988 | 2/1966 | Paige | 40/124.1 |
| 3,721,029 | 3/1973 | Austin | 40/124.1 |
| 4,146,983 | 4/1979 | Penick et al. | 40/124.1 |
| 4,337,589 | 7/1982 | Volkert et al. | 40/124.1 |
| 4,657,612 | 4/1987 | Schoenleber et al. | 156/227 |

*Primary Examiner*—Frank T. Yost
*Assistant Examiner*—Paul M. Heyrana, Sr.
*Attorney, Agent, or Firm*—Fitch, Even, Tabin & Flannery

[57] ABSTRACT

Promotional pieces in the form of printed items made from paper or other suitable sheet material are designed for mass production of a web press operation. After die-cutting and adhesive application, a printed continuous web is subjected to a series of manipulating steps of folding and/or severing and/or trimming to produce a folded, continuous web that can be transversely severed into a series of identical items, each including a pop-up assembly located between a pair of basepieces arranged in a folder-like construction. Upon the opening of the folder, a pair of pop-up panels interconnected along a central fold line rise from the planes of the respective basepieces carrying along therewith a placard, which may be a coupon or the like, that is prominently displayed in association with one of the pop-up panels in an attention-attracting mode.

12 Claims, 2 Drawing Sheets

11
21
27
23
25
15
17
19
22

13
29
33b
33b
33a
31a
27
15
35a
17
31b
36
35b
35b
25
29
30
23
30
A
35c
29
35a
31c
31d

13

27
25
31d

13

27
25
23
31c

13

25
23
17
31b

13

23
31a
17
15

13
40
17
15

27
25
23
22
15
17
11

42
17
31a
15

FIG. 10
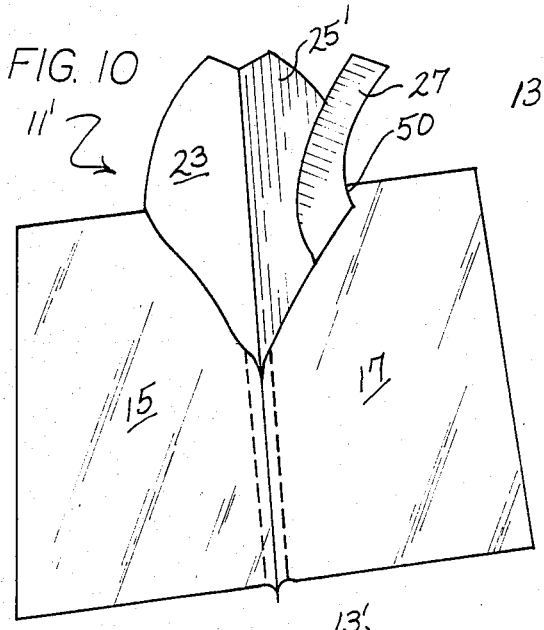
FIG. 11
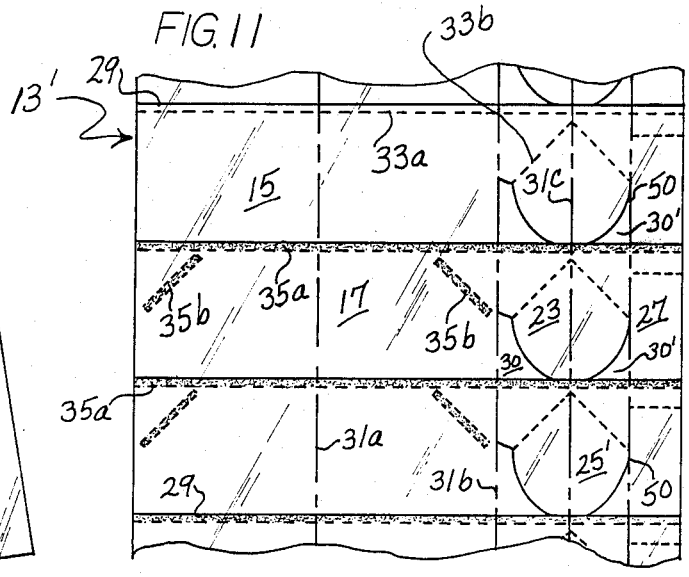
FIG 12
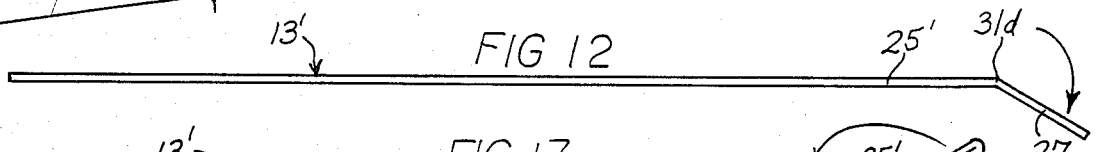
FIG 13
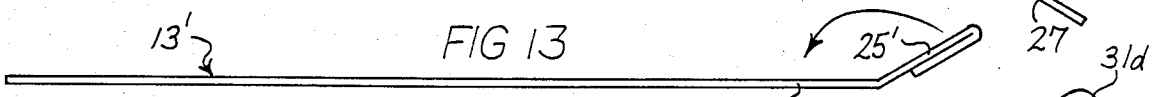
FIG 14
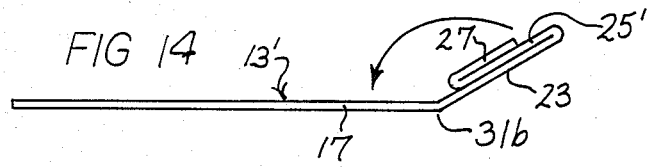
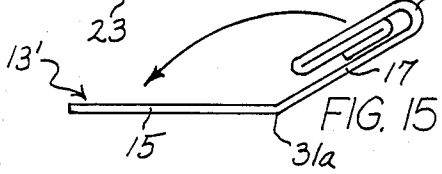
FIG. 15
FIG 16
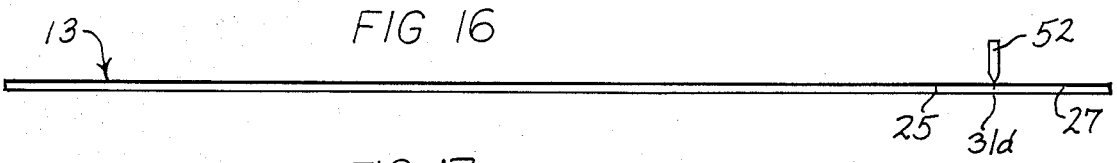
FIG 17
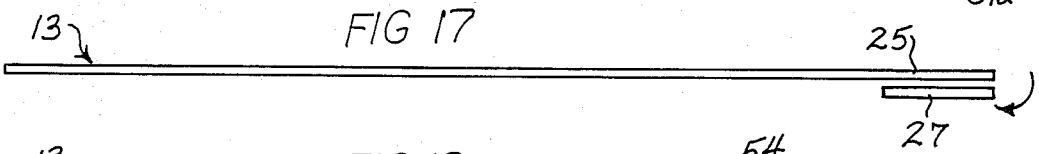
FIG 18
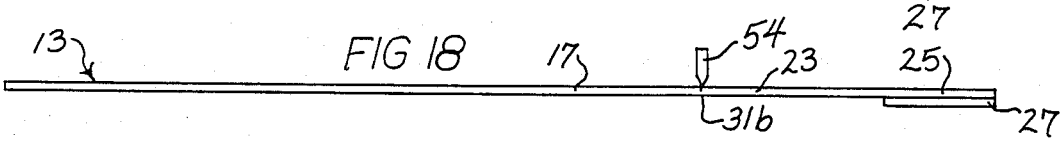
FIG 19
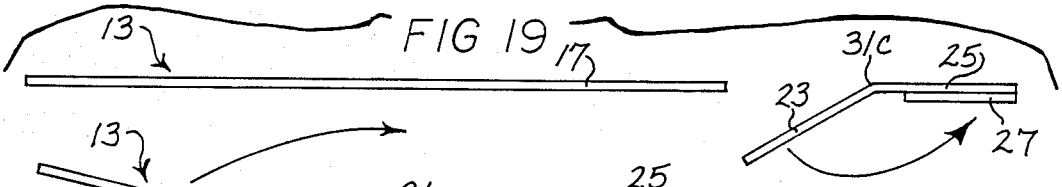
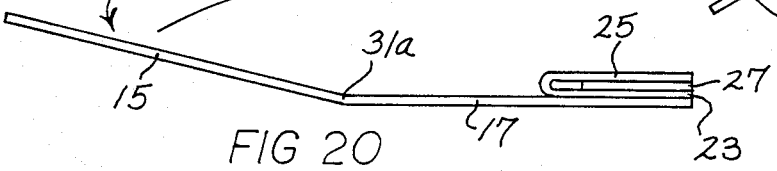
FIG 20

METHOD OF MAKING POP-UPS WITH PLACARD DISPLAY

The invention relates generally to paper printed novelty or promotional items and, more particularly, to methods of making dimensional and specialty paper products of this general character wherein a "pop-up" is provided.

BACKGROUND OF THE INVENTION

Promotional pieces have been recently created wherein a pop-up is provided between facing pages of a folder which, upon the opening of the folder, generally moves upward and outward of the planes of the folder pages; and of particular interest have been items of this general type which can be run automatically on a web press because such production methods facilitate economical mass production of these promotional items. U.S. Pat. No. 3,995,388, issued Dec. 7, 1976, discloses methods for making pop-up paper products having significant advantages over earlier hand-assembly methods that had been generally theretofor employed for making products of this general type. U.S. Pat. No. 4,146,983, issued Apr. 3, 1979, discloses methods for making other novel promotional items, particularly items which are designed to present a plurality of coupons to the recipient upon the opening of a folder. U.S. Pat. No. 4,337,589 discloses various other production methods for making a variety of pop-up paper products having different configurations on a web press.

As these promotional items have become more popular in the marketplace, improvements have been sought in the methods of web press production of items of this general type in order to provide a still greater variety of promotional features while maintaining the economics of mass production.

SUMMARY OF THE INVENTION

The present invention provides designs of folders which incorporate a pop-up wherein, in addition, a placard is associated with one of the pairs of pop-up panels in such a way that the placard is prominently displayed, extending generally alongside one of the pop-up panels in generally the same upward direction so as to attract attention to the message which it carries. For example, the placard can be printed in the form of a coupon which will be prominently displayed for the recipient to remove and hopefully utilize in purchasing the product in question. The entire item is, of course, designed to facilitate mass production on a web press.

BRIEF DESCRIPTION OF THE DRAWINGS

FIG. 10 is a perspective view of an alternative embodiment of a promotional item embodying various features of the invention which might be produced as a part of a web press operation;

FIG. 11 is a plan view of a web printed with blanks for forming item shown in FIG. 10;

FIGS. 12–15 are schematic views, similar to FIGS. 3–6, showing the manipulating steps used in the production of the item from the blanks shown in FIG. 11; and FIG. 16–20 are schematic view, similar to FIGS. 3–6, for treating the blanks shown in FIG. 2 in an alternative manner and still produce the promotional item depicted in FIG. 1.

DETAILED DESCRIPTION OF THE PREFERRED EMBODIMENTS

Figure 1:
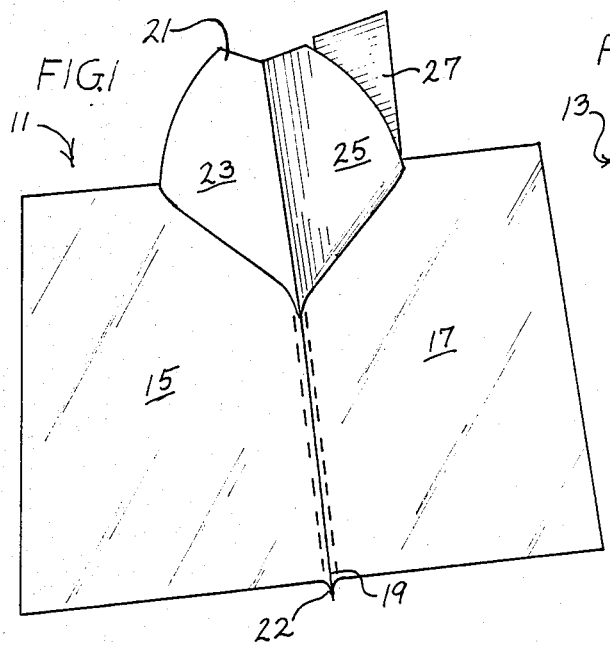
FIG. 1 is a perspective view of a promotional item made from a single blank on a web press operation which embodies the various features of the invention.
Figure 2:
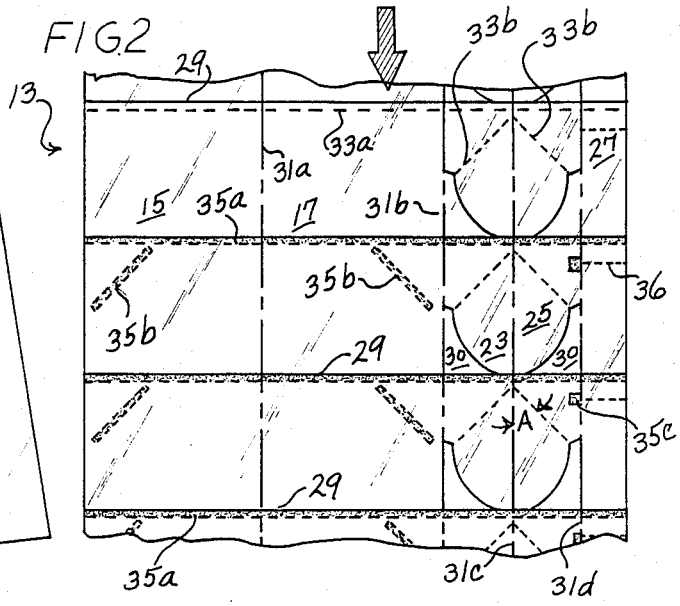
FIG. 2 is a plan view of a continuous web which may be used to produce the promotional item of FIG. 1, illustrating the die-cutting and adhesive application steps.
Figure 3:
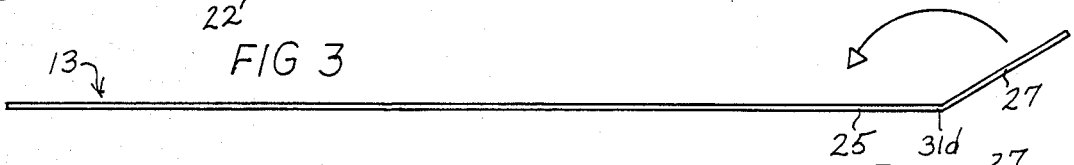
FIGS. 3 through 6 are schematic cross-sectional views showing a preferred folding operation for fabricating the web shown in FIG. 2 into the promotional item shown in FIG. 1.

A promotional piece 11 is shown in FIG. 1 and is formed from the web depicted in FIG. 2 which moves continuously through a series of folding and cutting operations to produce an endless series of identical promotional pieces.

Basically, the promotional piece 11 includes a pair of basepieces 15 and 17 which are hinged along a central line of interconnection 19 that is formed by the creation of a false backbone 22 along one edge of both of the basepieces. Located between the two basepieces is a pop-up assembly 21 which, in its folded condition, lies substantially flat and hidden between the basepieces 15, 17 that together can be viewed as constituting a folder. When the folder is opened by pivoting one of the basepieces relative to the other, the pop-up assembly 21 rises up out of the respective planes of the basepieces and preferably forms a part of the overall printed scene that the printed folder is depicting, for example, the billowed-out sail of a racing yacht.

The pop-up assembly 21 is formed from a pair of adjacent pop-up panels 23 and 25 which are hinged together along a central fold line 31*c*, having been cut from an integral web of paper, as depicted in FIG. 2. The pop-up assembly 21 includes a placard 27 which is arranged so that, when the pop-up rises up out of the planes of the basepieces the placard 27 is moved therewith and becomes prominently displayed adjacent one of the two pop-up panels with which it is associated, which in the illustrated embodiment is the panel 25. The placard may depict any type of an attention-getting item that fits in with the overall scene, or it may be something separate and apart from the scene, as for example, a coupon relating to the device or object or product which the promotional piece is intended to promote. For example, it could be a "Buy one, get one free" offer, a money off label, a "Buy one product, get another product free" offer or any of the other offers of this general type that are frequently used for promotion purposes. Alternatively, it could be a fascimile of a business card or the like which would be used to attract the recipient's attention to promote the use of the services of a particular vendor or any other such business solicitation that is often made.

Figure 7:
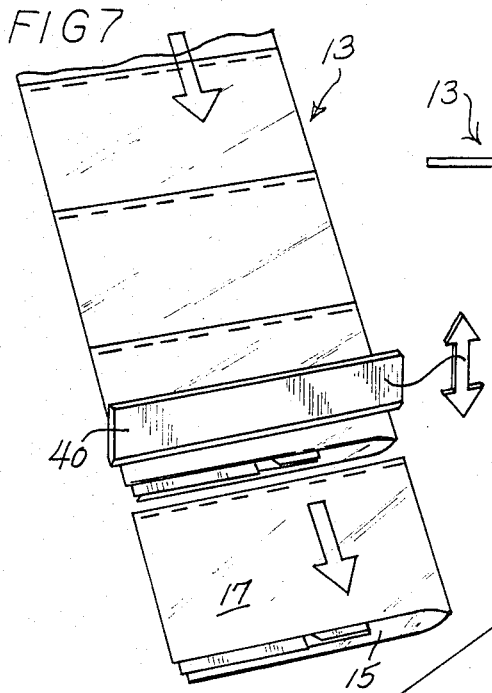
FIG. 7 is a schematic perspective view showing the transverse severing of the continuous web into a series of individual units, each of which is designed to be an identical promotional piece having the FIG. 1 configuration.
Figure 9:
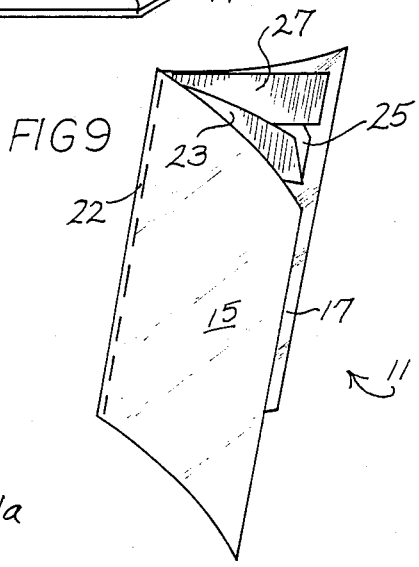
FIG. 9 is a perspective view of the item shown in FIG. 1 from a different angle which shows the arrangement looking downward into the pop-up panels.

FIG. 2 shows a region of the continuous web 13 as it might be running on a web printing press on which is demarcated a series of printed blanks that have been appropriately die-cut to remove paper from open regions, indicated by the reference numeral 30, which blanks will eventually form the promotional piece 11 illustrated in FIGS. 1 and 9. The blanks are shown demarcated for purposes of illustration by solid printed lines 29 which extend transversely to the direction of movement of the web which is depicted by the arrow at the top of FIG. 2. Thus, it will be understood that these transverse lines 29 are optional and are merely shown to indicate the locations where the web will be transversely slit, as shown in FIG. 7, to create multiple, identical units. Also shown in the blanks of FIG. 2 are a plurality of parallel broken lines 31 extending in the direction of the travel of the web which indicate boundaries between the different sections of each blank; these may be formed as lines of weakness in the blank, or alternatively may be omitted and left to be formed as a result of subsequent folding and/or severing operations. Further shown in the blanks are lines of slight perforations which are optional and which include the transverse hinge line 33*a* which lie adjacent what will become the false backbone region and the hinge lines 33*b* which are located at an angle to the direction of movement of the web and located in the pop-up panels. These slight perforations would normally be formed as a part of the die-cutting operation, but could alternatively be made by press scores or the like or could simply be omitted and left to be formed as a result of the natural resiliency of the paper to effect appropriate bending adjacent lines of adhesive that are employed.

The same die-cutting and adhesive application steps are effected to each of the successive blanks of the continuous sheet material web 13 which is preferably made of a suitable paper or paperboard material, glossy or matte finish as desired; alternatively, an appropriate thin, plastic sheeting material might be used that would accept printing As a part of the adhesive application step, a plurality of glue lines are laid down, as depicted in the lower blanks in FIG. 2. Although in the illustrated version the glue lines are preferably applied to the upper surface of the web, if desired, one or more glue lines or spots could be applied to the undersurface of the web, or the glue lines could be applied at a later stage during the fabrication process. Although these are commonly referred to in the trade as glue lines, any suitable adhesive can be used in the fabrication process, such as a hot melt or a solvent-based adhesive. Moreover, a heat-activated or an ultrasonic-activated adhesive might instead be applied, either before or after die-cutting, and such might even be applied by printing onto the continuous web. In such an instance, the adhesive character of the printed glue line might be sequentially activated to effect specific attachment between selective parts by subjecting one or more of the glue lines to heat or ultrasonic energy as appropriate. Alternatively, a final activation step might be carried out to finalize attachment of all of the glue lines of such a character. Likewise, although all of the glue lines are shown as having been applied to the web just after the die-cutting operation and before further manipulation takes place, this is optional, and there is no reason why one or more of the glue lines could not be applied at a later or an earlier stage of the fabrication process, even after the web has been slit into multiple ribbons and, for example, after one or more folding steps has occurred.

More specifically, the die-cutting step forms the upper edges of the pop-up panels 23, 25 and the light perforations 33*b* form the hinge lines along which those pop-up panels pivot in the final promotional piece. A transverse glue line 35*a* is applied which extends completely across the web in the region of the false backbone, and two angularly oriented glue lines 35*b* are located on the regions of the web which constitute the basepieces 15 and 17 at locations where they will lie adjacent to the angularly oriented hinge lines in the pop-up panels.

Figure 4:
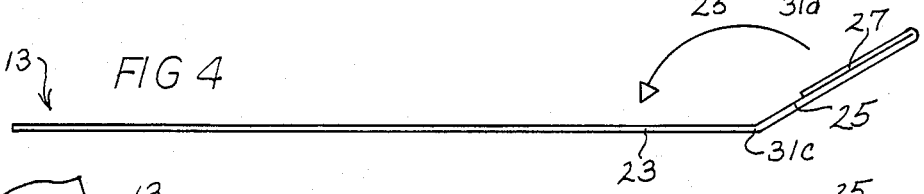
Figure 5:
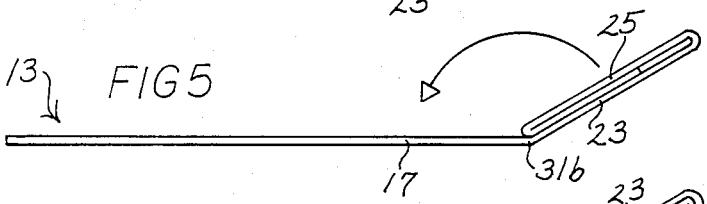
Figure 6:
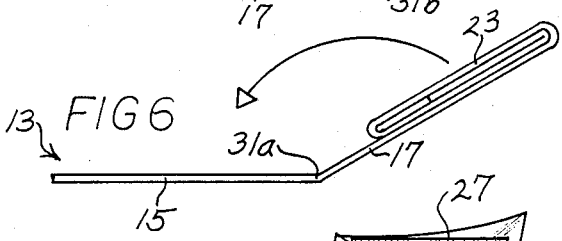

Following application of the adhesive pattern, the web travels to the manipulating steps illustrated in FIGS. 3 through 6. The far, right-hand region of the web, as illustrated in FIG. 2, constitutes the placard 27 and is preferably formed with a transverse perforation 36 to permit its detachment when its purpose in the overall promotional piece is to facilitate its eventual use separately from the rest of the piece, as, for example, if it were in the form of a coupon or a replica of a business card or the like. The initial folding step folds this region of the web along the line 31*d* onto the outer edge of the region which constitutes the pop-up panel 25 to which it is integrally attached as a result of the layout of the blank. The second folding step, depicted in FIG. 4, causes the pop-up panel 25 to be folded along the line 31*c* onto the pop-up panel 23, which in the blank shown in FIG. 2 is of the same width. As a result of this folding step, the placard 27 is sandwiched between the two pop-up panels 23 and 25. Next, as depicted in FIG. 5, the folded pop-up assembly 21 is folded along the line 31*b* onto the right-hand basepiece 17. In the final folding step, as depicted in FIG. 6, folding occurs along the line of demarcation 31*a* between the two basepieces so that the basepiece 17 and the pop-up assembly are brought into a superimposed position atop the basepiece 15. However, it should be understood that, if desired, the region constituting the basepiece 15 could be folded over the remainder of the blank.

Figure 8:
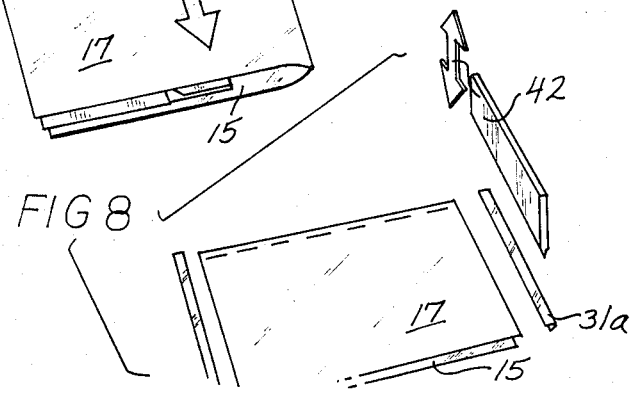
FIG. 8 shows a final trimming operation which is employed in the making of the promotional piece shown in FIG. 1.

As a result of these folding steps, all of the regions become attached to one another as a result of the line of adhesive 35*a* in the region of the false backbone, and adhesive bonds are created respectively between the pop-up panel 25 and the basepiece 17 and between the basepiece 15 and the pop-up panel 23 along the angular lines of adhesive 35*b*. At this time, the completely folded web may be subjected to compression using compression rolls or the like (not shown), as is well known in the art, so as to assure that secure adhesive bonds have been achieved. Thereafter, the web 13 is severed transversely to separate the continuous web into a plurality of identical, flat-folded, promotional pieces of identical construction, as depicted in FIG. 7 wherein this cutting is achieved by a schematically depicted reciprocating blade 40. It will, of course, be understood that, in many instances a rotary type cutter would be used. Either prior to or after the transverse severing, the right and left hand edges are trimmed, which operation could be done by reciprocating blades 42, as depicted in FIG. 8, when trimming the individual pieces; alternatively it could be done by rotary blades which might be preferred if trimming is done on the continuous web. The trimming operation, depicted in FIG. 8, along the right-hand edge eliminates the original line of joinder between the basepieces 15 and 17, leaving them thereafter interconnected only along the false backbone 22 so that, when the folded piece is opened, the basepieces pivot along the line of interconnection created by the false backbone aided by the lines of weakness which the light perforations provide. The trimming of the left-hand edge severs the original lines of interconnection 31*b* and 31*d* along which folding occurred between the base panel 17 and the pop-up panel 23 and between the pop-up panel 25 and the placard 27, thus leaving these elements generally interconnected to each other only along the adhesive bond at the region of the false backbone. However, an adhesive spot 35*c* can optionally be applied to the pop-up panel 25 in the region where the adhesive patterns 35*a* and 35*b* secure a portion of the pop-up panel 25 to the basepiece 17 to tack the placard in association therewith.

As best seen perhaps in FIG. 9, the final fabricated piece has the placard located within the confines of the pop-up panels 23, 25 and extending outward therepast because of the dimensioning of the pop-up panel 25 as a result of the die-cutting. As the folder is opened, the pop-up assembly 21 rises out of the planes of the basepieces with the extent of the pivoting movement being dependent upon the angular orientation of the adhesive lines 35*b* to the center line 31*c* of the pop-up, which angle should preferably be between about 30° and about 75° and is marked with the letter "A" in FIG. 2. As the pop-up assembly 21 rises up, the placard is moved as a result of its placement adjacent the inner surface of the pop-up panel 25, assisted by the optional tacking thereto by the adhesive spot 35*c*, and becomes prominently displayed, protruding from the region of the pop-up panels 23, 25. In the instance wherein the placard 27 is designed as a coupon, the recipient can easily detach it along the line of perforations 36 and then use it for its intended purpose with relation to the purchase of a product being promoted.

Depicted in FIG. 10 is an alternative embodiment of a promotional piece 11' which can be produced from the web 13' depicted in FIG. 11. Compared to the blanks illustrated in FIG. 2, the blanks illustrated in FIG. 11 are comparable with one exception. The region which constitutes the pop-up panel 25' is narrowed so that it is not quite as wide as the adjacent region from which the pop-up panel 23 is formed, and the die-cutting is modified slightly to remove regions 30' from the narrowed region such that the die-cut curved edge extends to the edge of the panel at a location spaced further from the false backbone 22 than the intersection of the perforated hinge line 33*b* and this edge. As a result of the proportioning and construction, the fold line 31*d* between the placard 27 and the pop-up panel 25' is not removed during the edge-trimming step, and as a result of the proportioning, a short fold line section 50 is left along which there will be hinged attachment of the placard to the main portion of the pop-up panel 25' that rises out of the plane of the basepiece 17.

In the folding operation, the region constituting the placard 27 is first folded under the region constituting the pop-up panel 25', as depicted in FIG. 12; thereafter, the folding is essentially the same as depicted in FIGS. 4–6. More specifically, the pop-up panel 25' is folded over the pop-up panel 23, and they remain secured in this arrangement through the glue line along the trailing edge of the blank that will become the false backbone 22. Next, the folded pop-up construction, with the placard panel 27 lying adjacent what will become the front surface of the pop-up panel 25', is folded onto the right-hand basepiece 17 along the line 31*b*, followed by the final folding step along line 31*a* wherein the two basepieces are brought into superimposed position as depicted in FIG. 15. Edge trimming and transverse severing steps are then carried out, as depicted in FIGS. 7 and 8, to produce the plurality of individual pieces. The trimming operation along the left-hand edge of the folded web severs the fold line 31*b* between the pop-up panel 23 and the basepiece 17; however, because of its narrower width, the panel 25, lies inside the region where the lateral edge is trimmed and thus remains intact. Accordingly, when the folder is opened and the pop-up panels 23, 25, rise up from the respective surfaces of the basepieces, the short line of interconnection along the fold line 50, between the placard 27 and the free edge of the pop-up panel 25', causes the placard 27 to also rise up from the surface of the basepiece 17 where it is prominently displayed with its free end loosely flapping adjacent the front surface of the pop-up panel 25', as depicted in FIG. 10.

Although FIGS. 3 through 6 illustrate the preferred method of manipulating the continuous web 13 to produce a plurality of identical promotional pieces 11, it should be understood that changes could be made to produce a promotional piece 11 by different sequences of manipulations. For example, as shown in FIGS. 16–20, the web 13 depicted in FIG. 2 could be die-cut and a similar adhesive pattern could be applied as described hereinbefore. Thereafter, severing could be carried out using a knife 52, as shown in FIG. 16, along the line 31*d* to create a separate ribbon from the web consisting of the region of the placard 27. As shown in FIG. 17, this ribbon is shifted and aligned below the right-hand lateral edge of the remaining web 13' in the region of the pop-up panel 25. The ribbon is held in this location as a result of adhesion provided by the glue line along the false backbone region. Next, a severing operation is carried out along the line 31*b* using a rotary knife 54 or the like to sever a ribbon constituting the two pop-up pieces 23, 25 from the remainder of the web, as depicted in FIG. 18. Next, a folding operation is carried out along the center line 31*c* of the pop-up 21 whereby the region constituting the pop-up panel 23 is folded under the region of the ribbon constituting the pop-up panel 23 to sandwich the placard 27 ribbon therebetween, as depicted in FIG. 19. If desired, a spot of adhesive, equivalent to the spot 35*c* in FIG. 2, could be provided on the undersurface of the region constituting the placards 27 generally adjacent the line of perforations 36, so as to tack the placard to the interior surface of the pop-up panel 23 upon the completion of the just-mentioned folding operation. This composite folded ribbon is then shifted over onto the right-hand edge of the portion of the web constituting the basepiece 17, as shown in FIG. 20, and is secured in place by the adhesive pattern 35*a* and also the angularly oriented glue line 35*b*. The final folding step superimposes the two basepieces as generally described with respect to FIG. 6. Trimming can then be carried out along both lateral edges of the web; however, the trimming along the one edge would be functionally unnecessary because of the severing operations that were earlier performed; however, it might be used to provide a look of neatness in the final product. The severing along the other edge would, of course, eliminate the fold line 31*a* between the basepieces 15 and 17 and, as pointed out before, could be carried out either before or after the transverse severing to create the identical individual units. Opening of the device would present the same appearance as that depicted in FIG. 1 with the exception that the pop-up panels 23 and 25 would be reversed, which would be taken into account in the printing. The optional inclusion of the glue spot would tack the placard generally in contact with the interior surface of the pop-up panel 23 beyond which it would protrude and be prominently displayed thereadjacent.

Although the foregoing constitutes the best modes contemplated by the inventor for carrying out this fabrication method, it should be understood that various changes and adaptations as would be obvious to one having the ordinary skill in the art may be made without departing from the scope of the invention, which is defined by the claims that are appended hereto. Although the pop-up panels are shown as being die-cut, depending upon the scene being depicted, the die-cutting might be omitted and the full pop-up panels used for the placard would still be displayed. With respect to the method illustrated in FIGS. 16–20, instead of placing the pop-up assembly along the right hand edge of the web 13, it might be placed centrally of the panel 17 to present a different effect. Moreover, the placard ribbon 27 could be placed atop the pop-up instead of underneath and the panel 23 folded over instead of under in FIG. 19. Particular features of the invention are emphasized in the claims that follow.

What is claimed is:

1. A method of making an item of the character described from a continuous web of sheet material comprising forming a series of similar blanks from a continuous web of sheet material so that each blank includes a pair of basepieces, a pair of pop-up panels, at least one of which pop-up panels is originally connected along a straight line to one of said basepieces, which line extends longitudinally of said continuous web, and placard means connected along a straight line to the other of said pop-up panels, applying an adhesive pattern to said sheet material blank, manipulating said sheet material blank so that said placard means is in surface contact with said other pop-up panel, then folding said blank so said pop-up panels are superimposed on each other sandwiching said placard means therebetween, further folding said blank so that said pop-up panels and said placard means are superimposed upon the portion of said blank constituting said basepieces, subsequently folding said blank while still a part of said continuous web along a straight line which extends longitudinally of said continuous web to complete the assemblage by bringing said basepieces into superimposed position with said pop-up panels sandwiched therebetween, whereby a minor region of each of said pop-up panels becomes respectively adhesively attached to one of said basepieces, transversely severing said continuous web to provide an individual assemblage separate from said web, and cutting one common edge of at least one of said basepieces and said other pop-up panel following said adhesive attachment to eliminate said original connection between said one pop-up panel and said one basepiece so as to free said edge of said pop-up panel and thereby allow said edge to move away from said one basepiece, whereby said basepieces are hingedly interconnected along a straight line in said individual assamblage, with said pop-up elements sandwiched therebetween and with each of said pop-up panels being pivotally attached to one of said basepieces at an acute to said line of hinged interconnection so that the pivoting of said basepieces about said line of hinged interconnection to an open position causes said pop-up panels to rise up out of the plane of each of said basepieces, the rising up of said pop-up panels causing movement of said placard means therewith and prominently displaying said placard means adjacent one pop-up panel.

2. A method in accordance with claim 1 wherein said blank is formed so that said basepieces are adjacent each other and said line of hinged interconnection is formed upon folding by adhesive engagement along a line perpendicular to said straight line about which said folding occurs.

3. A method in accordance with claim 2 wherein said blank is formed so that said one pop-up panel is originally connected to said basepiece along a fold line parallel to said straight line of folding between said basepieces.

4. A method in accordance with claim 1 wherein said blank is formed so that said one pop-up panel is originally connected along one edge to one of said basepieces and is connected along a parallel edge to said other pop-up panel.

5. A method in accordance with claim 4 wherein said blank is formed so that said placard means is originally connected to said other pop-up panel along a line parallel to said original connection hinge line.

6. A method in accordance with claim 5 wherein said manipulating step folds said blank so that said placard means is sandwiched between said pair of pop-up panels following the folding of said pop-up panels.

7. A method in accordance with claim 5 wherein said manipulating step folds said blank so that said placard means lies adjacent one surface of said other pop-up panel, the opposite surface of which is folded in surface contact with said one pop-up panel following the folding of said pop-up panels.

8. An item of the character described which is capable of mass production as a part of a continuous web comprising a pair of basepieces hinged together along a generally straight line so that one can be pivoted relative to the other to an open position;

a pop-up located between said basepieces including at least a pair of panels which are hingedly interconnected to each other, means joining a minor region of each of said panels respectively to one of said basepieces so that each said panel is pivotally connected to a basepiece along a line at an acute angle to said hinge line, placard means located between said pop-up panels, whereby the pivoting of said basepieces to the open position causes said pop-up panels to pivot about said respective lines of connection so that said pop-up rises up out of the planes of said basepieces, moving said placard means therewith and prominently displaying said placard means by visibly protruding past said pop-up panels.

9. An item in accordance with claim 8 wherein said basepieces and said pop-up panels are formed from an integral sheet and wherein said pop-up panels are formed integrally and joined to each other along a fold line which in the closed position is generally perpendicular to said basepiece hinge line.

10. An item in accordance with claim 8 wherein said placard means lies in surface-to-surface contact with one of said pop-up panels and is proportioned to extend beyond a free edge of said associated pop-up panel.

11. An item of the character described which is capable of mass production as a part of a continuous web comprising a pair of basepieces hinged together along a generally straight line so that one can be pivoted relative to the other to an open position, a pop-up located between said basepieces including at least a pair of panels which are hingedly interconnected to each other, means joining a minor region of each of said panels respectively to one of said basepieces so that each said panel is pivotally connected to a basepiece along a line at an acute angle to said hinge line, placard means located between one of said pop-up panels and one of said basepieces and being attached to said one pop-up panel, whereby the pivoting of said basepieces to the open position causes said pop-up panels to pivot about said respective lines of connection so that said pop-up rises up out of the planes of said basepieces, moving said placard means therewith as a result of its attachment to said one pop-up panel and prominently displaying said placard means.

12. An item in accordance with claim 11 wherein said placard means is attached by a hinge line along an edge thereof to said one pop-panel.

* * * * *

UNITED STATES PATENT AND TRADEMARK OFFICE

CERTIFICATE OF CORRECTION

PATENT NO. : 4,867,480

DATED : September 19, 1989

INVENTOR(S) : John K. Volkert

It is certified that error appears in the above-identified patent and that said Letters Patent is hereby corrected as shown below:

ABSTRACT, line 3, change "of" to --on--.

Column 2, line 14, after "forming", insert --the promotional--.

Column 2, line 18, change "view" to --views--.

Column 3, line 40, after "printing", insert a period.

Column 6, line 7, change "25," to --25'--.

Column 7, line 64, before "pop-up", insert --one--.

Column 8, line 4, after "acute", insert --angle--.

Signed and Sealed this

Second Day of July, 1991

*Attest:*

HARRY F. MANBECK, JR.

*Attesting Officer*

*Commissioner of Patents and Trademarks*